US006336979B1

(12) United States Patent
Sugawara et al.

(10) Patent No.: US 6,336,979 B1
(45) Date of Patent: Jan. 8, 2002

(54) WEAR RESISTANT COPPER BASE ALLOY, METHOD OF PREPARING THE SAME AND ELECTRICAL PART USING THE SAME

(75) Inventors: Akira Sugawara; Yoshitake Hana, both of Toyooka-mura; Takayoshi Endo, Haibara-cho, all of (JP)

(73) Assignees: Dowa Mining Co., Ltd.; Yazaki Corporation, both of Tokyo (JP)

( * ) Notice: Subject to any disclaimer, the term of this patent is extended or adjusted under 35 U.S.C. 154(b) by 0 days.

(21) Appl. No.: 09/493,997

(22) Filed: Jan. 27, 2000

(30) Foreign Application Priority Data

Jan. 27, 1999 (JP) ..... 11-017875

(51) Int. Cl.[7] ..... C23C 26/00

(52) U.S. Cl. ..... 148/536; 148/282; 148/284; 428/629; 428/647; 428/908.8; 428/929; 428/941

(58) Field of Search ..... 428/629, 632, 428/647, 674, 675, 469, 908.8, 926, 929, 935, 941; 148/282, 284, 518, 536, 433; 205/225, 226, 228, 300; 439/519, 524, 886, 887

(56) References Cited

U.S. PATENT DOCUMENTS 5,849,424 A 12/1998 Sugawara et al.
6,040,067 A * 3/2000 Sugawara et al. ..... 428/647

FOREIGN PATENT DOCUMENTS

EP 834602 4/1998
JP 1-225781 9/1989
JP 2-173294 7/1990
JP 7-126779 5/1995
JP 10-60666 3/1998
JP 12-164279 6/2000

* cited by examiner

*Primary Examiner*—Robert R. Koehler
(74) *Attorney, Agent, or Firm*—Frishauf, Holtz, Goodman, Langer & Chick, P.C.

(57) ABSTRACT

Wear resistant copper or a wear resistant copper base alloy having formed on the outermost surface thereof an oxide layer having a thickness of 10–1000 nm and a layer of an intermetallic compound primarily comprising Cu—Sn having a thickness of 0.1–10 μm under the oxide film layer is provided; a method of preparing the above-described wear resistant copper or copper base alloy by coating base material copper or a copper base alloy with Sn, preferably performing reflow treatment and then conducting heat treatment is provided; and an electrical part comprising the above-described wear resistant copper or copper base alloy is provided. A terminal made of the alloy according to the present invention which has an appropriate oxide film layer by performing heat treatment can greatly decrease a terminal-insertion force compared with that made of an ordinary copper base alloy which is not subjected to the heat treatment. The wear resistant copper or copper base alloy according to the present invention has a large surface hardness, an excellent slipping property, small contact resistance, an excellent electrical characteristic, as well as the small terminal-insertion force so that it can advantageously be used in an electrical part such as a connector or the like for use in an automobile, a charging socket or the like for use in an electric automobile.

14 Claims, 2 Drawing Sheets

WEAR RESISTANT COPPER BASE ALLOY, METHOD OF PREPARING THE SAME AND ELECTRICAL PART USING THE SAME

BACKGROUND OF THE INVENTION

The present invention relates to wear resistant copper or copper base alloys, a method of preparing the wear resistant copper or copper base alloys and electrical parts using the wear resistant copper or copper base alloys. Particularly, the present hi invention relates to a copper base alloy having a surface which requires reduced friction or a reduced friction coefficient at the time of insertion/extraction like that of a multiple-pin connector used in electrical wiring or the like, for example, in an automotive vehicle, a surface which undergoes many times of insertion/extraction like that, for example, of a charging socket used in an electric automobile, a surface which requires wear resistance like that of a brush of a motor that is in contact with a rotor or a surface which requires wear resistance/corrosion resistance like that of a terminal of a battery, a method of preparation thereof and an electrical part using the copper base alloy.

By virtue of the recent electronic development, electrical wiring of various kinds of machines has become complicated and highly integrated and, along with this development, the connector has come to have multiple pins therein. A conventional Sn-plated connector has high frictional resistance at the time of insertion and extraction to give rise to a problem that it becomes difficult for the connector to be inserted.

Since an electric automobile of today requires to be recharged more than once a day, it is necessary for a socket component for use in charging to secure wear resistance. Moreover, an electric current with more than 10 A (amperes) flows through the components to generate heat; therefore, there has been a problem that a conventional method of Sn-plating or the like causes separation and so forth of a plating layer prepared by the method.

For the purpose of reducing insertion force of a Sn-plated terminal having multiple pins or of securing wear resistance or adhesion of an electrical part such as the above-described charging socket, there has been proposed until now a plan for enhancing an apparent hardness by first applying a hard nickel-plating or the like to a substrate under the Sn-plating or providing a Cu—Sn diffusion layer and then applying Sn plating on the thus applied hard nickel-plating or the thus provided Cu—Sn diffusion layer.

However, the above-described hard nickel plating has drawbacks of high price and poor workability. Moreover, the proposal that the Cu—Sn diffusion layer is provided and then the Sn plating is applied thereon necessitates extremely complicated steps such that Sn-plating is applied on the copper or copper base alloy, heat diffusion is conducted to produce a Cu—Sn layer and Sn plating is applied again on the thus produced Cu—Sn layer. This causes a cost problem, as well as poor adhesion and workability of the surface Sn-plating so that the proposal can not be practical.

Namely, it has become apparent that the conventional surface treatment technique can not solve the above-mentioned problems. Moreover, though a technique which performs heat diffusion between the base metal and the plating layer by the surface heat treatment has conventionally been available, the conventional technique is no more than preventing the separation of the surface treated layer from the substrate which can be caused by the working of the product or due to the thermal effect by causing the diffusion between the surface treated layer and the base metal. Thus, the conventional technique can not solve the above-described problems.

SUMMARY OF THE INVENTION

Therefore, it is an object of the present invention to solve the above-described problems and to provide copper or a copper base alloy which is excellent in surface hardness, contact resistance, bending workability, adhesion and terminal insertion force, particularly, to provide a connector material which corresponds to a recent higher packaging density of electrical parts such as electrical equipment for use in automobiles or the like and other electrical parts which require wear resistance and corrosion resistance.

The present invention has solved the above-mentioned problems and provides copper or a copper base alloy with a surface which has a small coefficient of friction and also an excellent electrical characteristic such as contact resistance, namely, it has a surface suitable, for example, for a connector or a charging socket for use in an electric automobile. The aimed product can be produced by appropriately forming a very hard Cu—Sn system intermetallic compound (a Cu—Sn intermetallic compound layer such as $Cu_3Sn$, $Cu_4Sn$, $Cu_6Sn_5$ or the like, or a compound layer having a composition such as a Cu—Sn—X or the like wherein X is an additional element contained in the copper base alloy) and an oxide film layer with a controlled thickness on the surface of the copper or copper base alloy by first coating the surface thereof with Sn or a Sn alloy and then performing heat treatment. The present invention also provides a method of preparing the above proposed copper or copper base alloy as well as an electrical part utilizing the above proposed copper or copper base alloy.

The present invention is a technique which has been developed based on the following findings: by positively forming a Cu—Sn system intermetallic compound ($Cu_3Sn$, $Cu_4Sn$, Cu6Sn, or the like) which is excellent in surface hardness and contact resistance as well as an oxide film with a controlled thickness by defining a Sn film thickness to be applied to the base material and the conditions for heat treatment, it is possible to enhance the surface hardness of the surface layer to a level of Hv 250 or more, preferably Hv 300 or more; i.e., it is possible to improve the hardness of the surface layer to a level higher than the surface hardness of the Sn plating layer (Hv 60–120) or the hardness of the base material (Hv 80–250); it is possible to obtain an excellent slipping property by the presence of an oxide film with an appropriate thickness; and it is also possible to easily obtain contact resistance of 60 mΩ or less. Thus, the present invention provides copper or a copper base alloy having an electrical characteristic, workability, the surface of a small coefficient of friction as well as excellent wear resistance suitable for use in a connector for an automobile or a charging socket or the like for an electric automobile. The invention also provides a method of preparing the above mentioned copper or copper base alloy as well as an electrical part utilizing the above mentioned copper or copper base alloy.

According to a first aspect of the present invention, there is provided a wear resistant copper or copper base alloy having formed on the outermost surface thereof an oxide film layer having a thickness of 10–1000 nm and also having a layer of an intermetallic compound primarily comprising Cu—Sn under the oxide film layer.

According to a second aspect of the present invention, there is provided a wear resistant copper or copper base alloy provided with an oxide film layer having a thickness of 10–1000 nm on an outermost surface thereof and an intermetallic compound primarily comprising Cu—Sn having a thickness of 0.1–10 μm under the oxide film layer.

According to a third aspect of the present invention, there is provided a method of preparing a wear resistant copper or copper base alloy comprising the steps of:

coating copper or a copper base alloy with Sn; and performing heat treatment to thereby form an oxide film layer having a thickness of 10–1000 nm on an outermost surface thereof and a layer of an intermetallic compound primarily comprising Cu—Sn under the oxide film layer.

According to a fourth aspect of the present invention, there is provided a method of preparing a wear resistant copper or copper base alloy comprising the steps of:

coating copper or a copper base alloy with Sn; and performing heat treatment to thereby form an oxide film layer having a thickness of 10–1000 nm on an outermost surface thereof and a layer of an intermetallic compound having a thickness of 0.1–10, m primarily comprising Cu—Sn under the oxide film layer.

According to a fifth aspect of the present invention, there is provided a method of preparing a wear resistant copper or copper base alloy comprising the steps of:

coating copper or a copper base alloy with Sn;

performing reflow treatment; and performing heat treatment to thereby form an oxide film layer having a thickness of 10–1000 nm on an outermost surface thereof and a layer of an intermetallic compound primarily comprising Cu—Sn under the oxide film layer.

According to a sixth aspect of the present invention, there is provided a method of preparing a wear resistant copper or copper base alloy comprising the steps of:

coating copper or a copper base alloy with Sn;

performing reflow treatment; and performing heat treatment to thereby form an oxide film layer having a thickness of 10–1000 nm on an outermost surface thereof and a layer of an intermetallic compound primarily comprising Cu—Sn having a thickness of 0.1–10 μm under the oxide film layer.

According to a seventh aspect of the present invention, there is provided an electrical part comprising a wear resistant copper or copper base alloy with an oxide film layer having a thickness of 10–1000 nm formed on an outermost surface thereof and a layer of an intermetallic compound primarily comprising Cu—Sn formed under the oxide film layer.

According to an eighth aspect of the present invention, there is provided an electrical part comprising a wear resistant copper or copper base alloy with an oxide film layer having a thickness of 10–1000 nm formed on an outermost surface thereof and a layer of an intermetallic compound primarily comprising Cu—Sn having a thickness of 0.1–10 μm formed under the oxide film layer.

According to a ninth aspect of the present invention, there is provided an electrical part comprising a wear resistant copper or copper base alloy prepared by a method comprising the steps of:

coating copper or a copper base alloy with Sn; and performing heat treatment to thereby form an oxide film layer having a thickness of 10–1000 nm on an outermost surface thereof and a layer of an intermetallic compound primarily comprising Cu—Sn under the oxide film layer.

According to a tenth aspect of the present invention, there is provided an electrical part comprising a wear resistant copper or copper base alloy prepared by a method comprising the steps of:

coating copper or a copper base alloy with Sn; and performing heat treatment to thereby form an oxide film layer having a thickness of 10–1000 nm on an outermost surface thereof and a layer of an intermetallic compound primarily comprising Cu—Sn having a thickness of 0.1–10 μm under the oxide film layer.

According to an eleventh aspect of the present invention, there is provided an electrical part comprising a wear resistant copper or copper base alloy prepared by a method comprising the steps of:

coating copper or a copper base alloy with Sn;

performing reflow treatment; and performing heat treatment to thereby form an oxide film layer having a thickness of 10–1000 nm on an outermost surface thereof and a layer of an intermetallic compound primarily comprising Cu—Sn under the oxide film layer.

According to a twelfth aspect of the present invention, there is provided an electrical part comprising a wear resistant copper or copper base alloy produced by a method comprising the steps of:

coating copper or a copper base alloy with Sn;

performing reflow treatment; and performing heat treatment to thereby form an oxide film layer having a thickness of 10–1000 nm on an outermost surface thereof and a layer of an intermetallic compound primarily comprising Cu—Sn having a thickness of 0.1–10 μm under the oxide film layer.

According to a thirteenth aspect of the present invention, there is provided the wear resistant copper or copper base alloy described in the first or second aspect in which contact resistance thereof is 60 mΩ or less.

According to a fourteenth aspect of the present invention, there is provided the method of preparing the wear resistant copper or copper base alloy described in the third to sixth aspects in which contact resistance thereof is 60 mΩ or less.

According to a fifteenth aspect of the present invention, there is provided the electrical part described in the seventh to twelfth aspects in which contact resistance of the copper or copper base alloy is 60 mΩ or less.

According to a sixteenth aspect of the present invention, there is provided the copper or copper base alloy described in the first, second or thirteenth aspect in which surface hardness thereof is Hv 250 or more.

According to a seventeenth aspect of the present invention, there is provided the method of preparing the wear resistant copper or copper base alloy described in the third to sixth aspects or the fourteenth aspect in which surface hardness thereof is Hv 250 or more.

According to an eighteenth aspect of the present invention, there is provided the electrical part described in the seventh to twelfth aspects or the fifteenth aspect, in which surface hardness thereof is Hv 250 or more.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:.

DETAILED DESCRIPTION OF THE INVENTION

Figure 1:
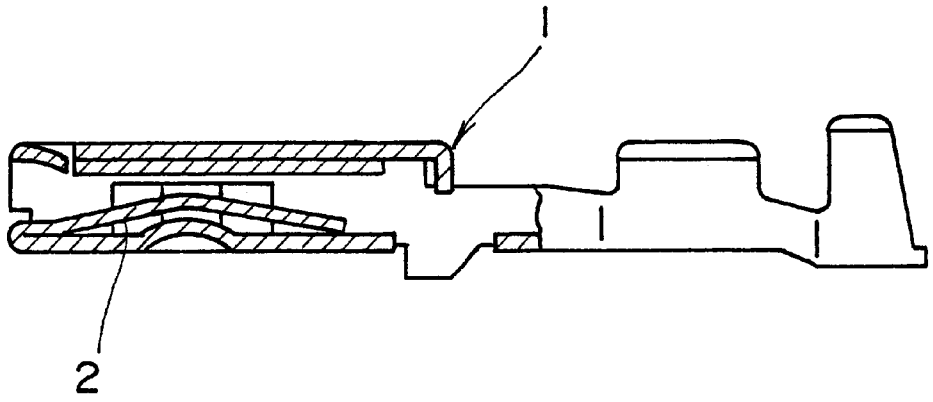
FIG. 1 is a partial cross-sectional side view illustrating a female terminal made of a copper base alloy prepared in the working and comparative examples of the present invention.

An oxide film with a desired thickness can be formed on the surface of a Sn plating layer by first forming the Sn plating layer on the surface of a base material made of copper or a copper base alloy by electric plating or the like, secondly either performing or not performing reflow treatment and then performing heat treatment preferably in an atmosphere in which oxygen content is controlled, and at the same time a layer of Cu—Sn intermetallic compound can be formed under the oxide film layer by causing mutual diffusion between Cu or Cu plus additional elements from the base material and Sn from the plating layer.

If the thickness of the Sn coating formed by the electric plating or the like is less than 0.1 $\mu$m, corrosion resistance decreases. Particularly, corrosion by $H_2S$, $SO_2$ or $NH_3$ gas in the presence of water will become a serious problem. On the contrary, if the thickness of the Sn film exceeds 10 $\mu$m, the thickness of a diffusion layer becomes so thick that decrease of workability which will cause cracking or the like at the time of molding is noticed and further that a problem of decrease of fatigue characteristic, economic disadvantage or the like is brought about. Therefore, the thickness of the Sn film is preferably within the range of from 0.1 to 10 $\mu$m, more preferably, from 0.3 to 5 $\mu$m.

As an undercoat for the Sn coating, a plated Cu film can be formed on the base material. Cu plating or the like may be performed. Cu of the undercoat serves as forming a Cu—Sn system intermetallic compound and effectively prevents excessive diffusion of the additional element of the copper alloy.

However, if the resultant Cu undercoat becomes too thick, the diffusion layer becomes too thick thereby decreasing the workability. Therefore, a thickness of the Cu undercoat is preferably 10 $\mu$m or less, more preferably, 3 $\mu$m or less. If the Cu undercoat is used, materials other than the copper base alloy such as steel, iron, stainless steel, aluminum alloy or the like can be used as a base metal. However, from the standpoint of characteristics or the like required for an electrical part, the base metal is preferably copper or a copper base alloy. By forming a wear resistant layer according to the present invention using at least one of the above-described base metals, a metal with a contact resistance of 60 $\mu$m$\Omega$ or less which is useful for an electrical part can easily be obtained.

Moreover, from the standpoint of strength, elasticity, electrical conductivity, workability, corrosion resistance or the like, the additional element in the copper base alloy preferably comprises at least one of the following elements within respective specified content ranges and is within a total content range of 0.01–40 wt %:

Zn: 0.01–40 wt %, Sn: 0.1–10 wt %, Fe: 0.01–5 wt %, Ni: 0.01–10 wt %,

Co: 0.01–5 wt %, Ti: 0.01–5 wt %, Mg: 0.01–3 wt %, Zr: 0.01–3 wt %,

Ca: 0.01–1 wt %, Si: 0.01–3 wt %, Mn: 0.01–10 wt %, Cd: 0.01–5 wt %,

Al: 0.01–10 wt %, Pb: 0.01–5 wt %, Bi: 0.01–5 wt %, Be: 0.01–3 wt %,

Te: 0.01–1 wt %, Y: 0.01–5 wt %, La: 0.01–5 wt %, Cr: 0.01–5 wt %,

Ce: 0.01–5 wt %, Au: 0.01–5 wt %, Ag: 0.01–5 wt %, P: 0.005–0.5 wt %.

Unless otherwise specified, all parts and percentages herein are given by weight.

As a method of forming the Sn film, electroplating or hot-dip coating is economical from the standpoint of adhesion or uniformity of the film. However, in order to obtain a thin and uniform coating, the method of electroplating is most preferred. As for Sn to coat with, a Sn-Pb alloy with the Sn content of 5% or more is also effective. If the content of Pb exceeds 95%, however, it is difficult to obtain the desired hardness or slipping property due to Pb present in the surface layer after thermal diffusion. To perform the treatment for reflowing after the formation of Sn coating is favorable because it increases smoothness and uniformity of the surface which has previously undergone thermal diffusion.

The thickness of the oxide film of the outermost surface is to be 10–1000 nm. If the thickness of the oxide film is less than 10 nm, the slipping property decreases, cohesive friction is likely to be generated and terminal-insertion force increases. If the thickness of the oxide film exceeds 1000 nm, contact resistance increases or becomes unstable so that the electrical property is deteriorated. Then, a case may occurs where adhesion of the oxide film decreases to cause a separation at succeeding processing. A more preferred thickness of the oxide film is 15–300 nm. The oxide film may be any one of the compounds selected from the group consisting of tin oxides, Cu—Sn—O, Cu—Sn—X—O and an X—O compound (X represents an additional element contained in the copper base alloy). There are no particular limitations to the proportions of any component elements. Such oxide material formed on the surface enhances the wear resistance and slipping property in cooperation with the Cu—Sn diffusion layer. Though a surface oxide layer can be formed on the Sn coating layer itself by heating or the like, it is difficult to obtain all of the above-described effects unless a hard diffusion layer exists. In a case in which the aforementioned coating is utilized in a male or female terminal of an electrical part, the coating can be applied to at least one of the male and female terminals. Moreover, the coating may be applied only to a necessary portion of either one or both of them.

ILLUSTRATIVE EMBODIMENTS

The following examples are given to illustrate the present invention and should not be interpreted as limiting it in any way.

EXAMPLE 1

Sample materials having a thickness of 0.25 mm which comprise copper or a copper base alloy having the respective chemical compositions (% by weight) shown in Table 1 as base metals were prepared, coated with Sn by means of electroplating in a sulfuric acid bath and thereafter subjected to heat treatment so as to cause Cu—Sn diffusion.

In the above case, sample materials having various thickness of Sn coatings were prepared and, moreover, some of them were subjected to reflow treatment after Sn plating processing was conducted. A temperature and time of heat treatment for causing the Cu—Sn diffusion were set as 250° C. and 2 hours, respectively, and each of the oxide films having various thickness was formed on the outermost surface by controlling the oxygen content in the atmosphere of heat treatment. The thickness of the oxide film was measured by an analyser in accordance with AES or ESCA.

The thus prepared sample materials are shown in Table 1 as sample numbers 1 to 7.

Test for determining hardness, contact resistance and bending characteristics were conducted. The hardness test was conducted in accordance with the test method set forth in JIS-Z-2244. The contact resistance test was conducted with a low voltage and low current measuring instrument and the measurement was effected by a four-terminal method. The electric resistance was measured by changing the maximum load on the Au probe from 0 g to 20 g.

The measurement of bending workability was effected in accordance with the 90° W bending test (CES-M-0002-6, R=0.2 mm, in the directions of both parallel and normal to the direction of rolling) and then the peeling test was conducted by means of a tape. Thus, workability and adhesion were determined. After the bending test, the surface state of the center ridge was evaluated by the following criteria: ○ stands for no cracking or no separation being found; and X stands for either or both of cracking and separation being found.

Results obtained by the above tests are shown in Table 2.

From the test results shown in Table 2, it is found that copper or copper base alloys of sample material numbers 1 to 7 according to the present invention have been remarkably improved in the surface hardness and are excellent in contact resistance, bending workability and adhesion. Therefore, they are alloys which have excellent characteristics suitable for use in a connector, a charging socket or the like.

Moreover, an alloy sample which has the same composition as that of the sample material number 6 of Example 1 and which has not been subjected to reflow treatment was prepared. Then, the surface roughness of the sample material was examined after it has been subjected to the heat treatment. The measuring result is shown in Table 3 as sample material number 11 together with the result of the above-described sample material number 6.

It is found from Table 3 that the material of sample number 6 which has been subjected to reflow treatment after forming Sn plating is superior in the surface roughness after thermal diffusion treatment to the material of sample number 11 which has not been subjected to reflow treatment after forming Sn plating. Therefore, it can be stated that it is preferred to conduct the reflow treatment after forming the Sn coating by plating.

TABLE 1

| Sample Material Numbers | Sn Film Thickness (μm) | Presence (Yes) or Absence (No) of Reflow Treatment | Oxide Film Thickness (nm) | Base Metals (wt %) |
|---|---|---|---|---|
| Examples | | | | |
| 1 | 1.0 | No | 290 | Oxygen-free Copper |
| 2 | 0.6 | No | 30 | Cu-30Zn |
| 3 | 1.1 | Yes | 30 | Cu-30Zn |
| 4 | 0.8 | Yes | 30 | Cu-2Sn-0.1Fe-0.03P |

TABLE 1-continued

| Sample Material Numbers | Sn Film Thickness (μm) | Presence (Yes) or Absence (No) of Reflow Treatment | Oxide Film Thickness (nm) | Base Metals (wt %) |
|---|---|---|---|---|
| 5 | 1.9 | No | 20 | Cu-1Ni-0.9Sn-0.0SP |
| 6 | 1.1 | Yes | 25 | Cu-1Ni-0.9Sn-0.05P |
| 7 | 2.5 | Yes | 140 | Cu-2Sn-0.1Fe-0.03P |
| Comparative Examples | | | | |
| 8 | 12 | No | 500 | Oxygen-free Copper |
| 9 | 2.0 | No | 1400 | Cu-30Zn |
| 10 | 0.08 | No | 120 | Cu-1Ni-0.9Sn-0.05P |

TABLE 2

| Sample Material Numbers | Surface Vickers Hardness (Hv) | Contact Resistance (mΩ) | Bending Workability | Adhesivity |
|---|---|---|---|---|
| Examples | | | | |
| 1 | 270 | 7 | ○ | ○ |
| 2 | 300 | 10 | ○ | ○ |
| 3 | 310 | 8 | ○ | ○ |
| 4 | 290 | 9 | ○ | ○ |
| 5 | 340 | 9 | ○ | ○ |
| 6 | 350 | 8 | ○ | ○ |
| 7 | 390 | 10 | ○ | ○ |
| Comparative Examples | | | | |
| 8 | 310 | 5 | x | ○ |
| 9 | 325 | 130 | ○ | x |
| 10 | 210 | 32 | ○ | ○ |

TABLE 3

| Sample Material | Presence (Yes) or Absence (No) of Reflow | Surface Roughness before Heat Treatment (μm) | | Surface Roughness after Heat Treatment (μm) | |
|---|---|---|---|---|---|
| Numbers | Treatment | Ra | Rmax | Ra | Rmax |
| 6 | Yes | 0.05 | 0.67 | 0.07 | 0.92 |
| 11 | No | 0.07 | 0.85 | 0.13 | 1.89 |

COMPARATIVE EXAMPLE 1

As comparative examples, sample materials of sample numbers 8 to 10 were prepared by the same processing manner as in the examples described above except that the thickness of Sn film or the thickness of the surface oxide film was outside the range specified in the present invention. Hardness, contact resistance, bending workability and adhesion of these sample materials were evaluated. Results of the evaluation are additionally shown in Table 2.

As is known from the results, the sample material of sample material number 8 which has a large Sn film thickness and, therefore, is outside the range of the present invention is not suitable as a material for use in an electrical part. Also, the sample material of sample material number 9 whose oxide film thickness is so large as to be outside the range of the present invention is not suitable as a material for use in an electrical part. Moreover, the sample material of sample material number 10 whose Sn coating thickness is so small that it can not improve the surface hardness and therefore is not suitable as a material for use in an electrical part.

EXAMPLE 2

Figure 2:
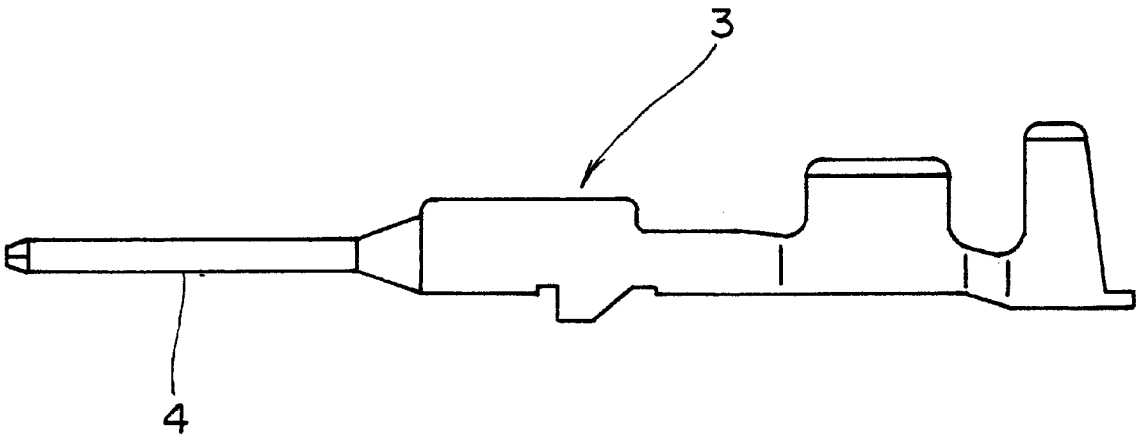
FIG. 2 is a side view illustrating a male terminal made of a copper base alloy prepared in the working and comparative examples of the present invention.

A sample material of sample material number 6 in Table 4 which has been treated according to the present invention was press-formed to produce terminals shown in FIGS. 1 and 2, and then evaluated the material as the terminal.

FIG. 1 shows a female terminal 1 having a spring portion 2 therein and FIG. 2 shows a male terminal 3 having a tab portion 4 therein. Insertion force the improvement of which is one of the objects of the alloy according to the present invention, as well as electrical characteristics were evaluated on them.

Figure 3:
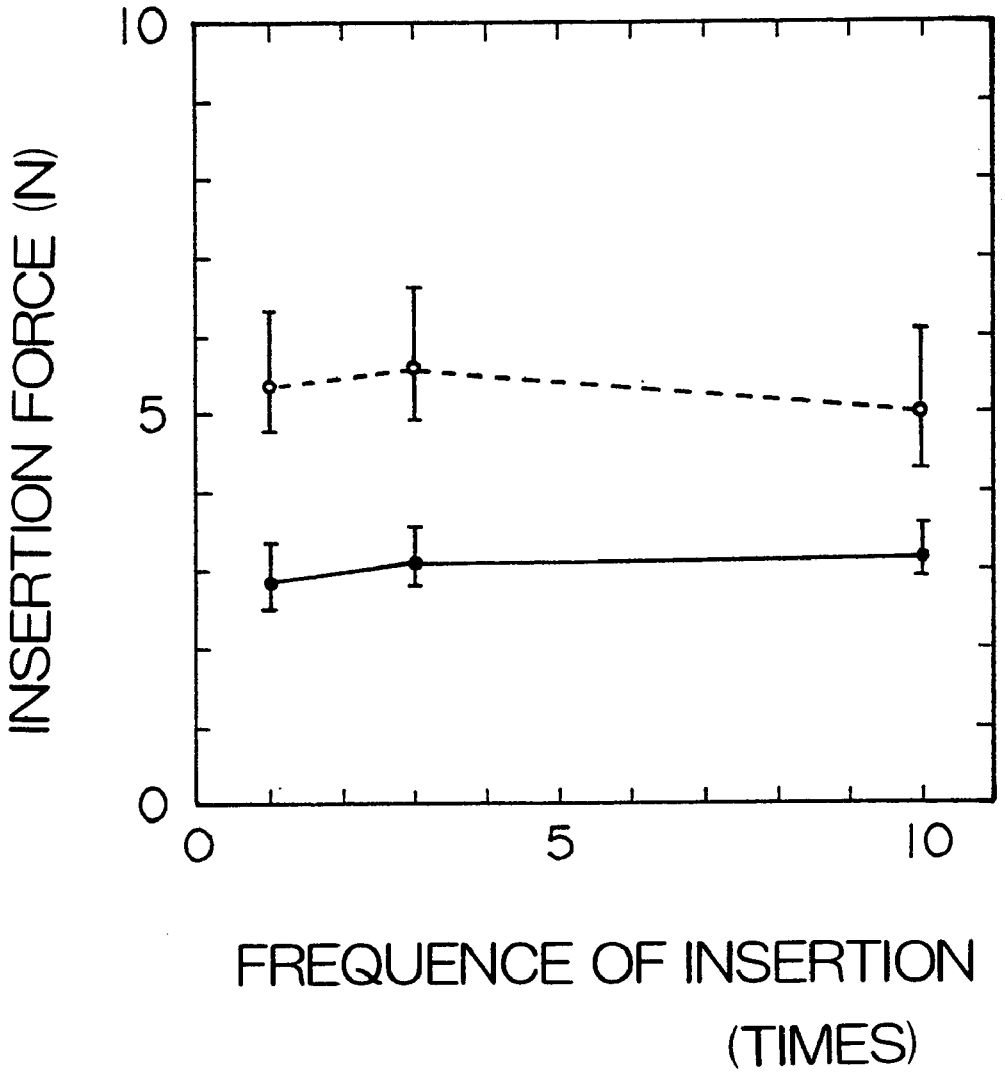
FIG. 3 is a graph showing the relationship between insertion time and insertion force in a combination of the female terminal of FIG. 1 and the male terminal of FIG. 2.

The insertion force was measured with a load cell by inserting the male terminal shown in FIG. 2 into the female terminal shown in FIG. 1 made of the sample material at a speed of 10 mm/minute. Results of the measurements are shown in Table 5. Also, changes of the insertion force in accordance with the frequence of insertion are shown in FIG. 3, along with respective scattering ranges.

Further, resistance at low voltage and low current after 10 times of insertion/extraction operations was measured in accordance with JIS C 5402 and the result is shown in Table 6.

TABLE 4

| Sample Material Numbers | Presence of Heat Treat-ment | Sn Film Thick-ness (μm) | Oxide Film Thickness (nm) | Base Materials (wt %) |
|---|---|---|---|---|
| Examples 6 | Yes | 1.1 | 25 | Cu-1Ni-0.9Sn-0.05P |
| Comparative Examples 12 | No | 1.1 | 6 | Cu-1Ni-0.9Sn-0.05P |

TABLE 5

| Sample Material Numbers | Vickers Hardness (Hv) | Frequence Of Insertion | Insertion Force (N) |
|---|---|---|---|
| Examples 6 | 350 | First time | 2.85 |
| | | Third time | 3.11 |
| | | Tenth time | 3.28 |
| Comparative Examples 12 | 116 | First time | 5.35 |
| | | Third time | 5.57 |
| | | Tenth time | 5.01 |

TABLE 6

| Sample Material Numbers | Initial Contact Resistance (mΩ) | Contact Resistance (mΩ) after Times of Insertion/Extraction Operations |
|---|---|---|
| Examples 6 | 1.8 | 1.9 |
| Comparative Examples 12 | 1.7 | 1.9 |

COMPARATIVE EXAMPLE 2

A comparative sample material, which is of the same base metal as the sample material of sample material number 6 and which has been subjected to the same plating treatment as the previous processing but has not been subjected to thermal diffusion treatment, is additionally shown in Table 4 as sample material number 12.

Insertion force and hardness of the comparative sample material of sample material number 12 were measured in the same way as in the above-described sample material of sample material number 6 and results are additionally shown in Table 5, as well as FIG. 3.

Moreover, resistance at low voltage and low current thereof was measured in the same way as in the above-described sample material of sample material number 6 and a result is additionally shown in Table 6.

It is found from Table 5 and FIG. 3 that the insertion force of a terminal made of the material of sample material number 6 according to the present invention which has been Sn plated, reflowed and heat treated is decreased compared with a terminal made of the sample material of sample material number 12 which is similar to the conventional sample material; and the scattering range is also decreased. Moreover, it is found that the change of the insertion force with repetition of insertion/extraction operations is small and consistent so that it can be said that the hardness is large and the wear resistance is excellent.

Further, it is found from Table 6 that resistance at low voltage and low current both at an initial stage and after a durability experience of the alloy according to the present invention is similar to that of the conventional alloy.

From the above findings, the terminal which is capable of substantially decreasing the insertion force without increasing resistance and which has an excellent characteristic in wear resistance can be obtained with the alloy according to the present invention.

COMPARATIVE EXAMPLE 3

A sample material having the same composition as that of the sample material of sample material number 6 was subjected to the same Sn coating treatment as the sample material of sample material number 6 and then the thus Sn-coated sample material was heated in a stream of hydrogen to prepare a comparative sample material having a Cu—Sn diffusion layer and an extremely thin oxide film formed on the surface. Insertion force of the resultant comparative sample material was measured in the same way as in the case of Example 2 and the result is additionally shown in Table 7. It is found from Table 7 that slipping property is enhanced and insertion force of the terminal is decreased by obtaining the oxide film thickness specified in the present invention.

TABLE 7

| Sample Material Numbers | Oxide Film (nm) | Insertion Force (N) |
|---|---|---|
| Examples 6 | 25 | 2.85 |
| Comparative Examples 12 | 7 | 3.38 |

While the wear resistant copper or copper base alloy, the method of preparing the wear resistant copper or copper base alloy and the electrical part using the wear resistant copper or copper base alloy according to the present invention have been described in the foregoing pages in detail, it should be understood that the present invention is by no means limited to the above embodiments and various improvements and modifications may of course be made without departing from the scope and spirit of the present invention.

According to copper or a copper base alloy according to the present invention which has a thickness-controlled oxide film on an outermost surface thereof and a Cu—Sn system intermetallic compound under the oxide film, the copper or copper base alloy provided with a wear resistant coating having a surface with large surface hardness, an excellent slipping property and a small friction coefficient can be obtained. Moreover, this copper or copper base alloy has an excellent adhesion to the coating so that it has an excellent bending workability. Further, it has an excellent electrical characteristic such as a small contact resistance, as well as a terminal made thereof has a small insertion force. As a result, the copper or copper base alloy is capable of being advantageously used in a connector material which is adaptable to the recent highly integrated electric equipment for use in an automobile or the like and an electrical part in which the wear resistance and corrosion resistance are required.

Moreover, it can effectively and firmly secure an electric characteristic such as contact resistance or the like, workability such as adhesion or the like, as well as corrosion resistance by being provided with a Cu—Sn system intermetallic compound with an appropriately controlled thickness.

According to the method of the present invention which performs beat treatment after forming an Sn layer, wear resistant copper or copper base alloy having the above-described various characteristics can effectively and easily be produced. In addition, by performing reflow treatment and then heat treatment, the copper or copper base alloy having an excellent surface characteristic such as surface roughness or the like after undergoing the heat treatment can effectively be obtained.

What is claimed is:

1. A method of preparing wear resistant copper or a wear resistant copper base alloy comprising the steps of:

coating copper or a copper base alloy with Sn;

performing reflow treatment; and performing heat treatment to thereby form an oxide film layer having a thickness of 1–1000 nm on an outermost surface thereof and an intermetallic compound primarily comprising Cu—Sn under the oxide film layer.

2. A method of preparing wear resistant copper or a wear resistant copper base alloy comprising the steps of:

coating copper or a copper base alloy with Sn;

performing reflow treatment; and performing heat treatment to thereby, form an oxide film layer having a thickness of 10–1000 nm on the outermost surface thereof and a layer of an intermetallic compound primarily comprising Cu—Sn having a thickness of 0.1–10 $\mu$m under the oxide film layer.

3. The method of preparing the wear resistant copper or copper base alloy according to claims 1 or 2, wherein said wear resistant copper or copper base alloy has a contact resistance of 60 m$\Omega$ or less.

4. The method of preparing the wear resistant copper or copper base alloy according to claims 1 or 2, wherein the wear resistant copper or copper base alloy has a surface hardness, Hv, of 250 or more.

5. The method of preparing the wear resistant copper or copper base alloy according to claim 3, wherein the wear resistant copper or copper base alloy has a surface hardness, Hv, of 250 or more.

6. The method of preparing the wear resistant copper or copper base alloy according to claim 1, wherein the Cu—Sn is selected from the group consisting of $Cu_3Sn$, $Cu_4Sn$ and $Cu_6Sn_5$.

7. The method of preparing the wear resistant copper or copper base alloy according to claim 1, wherein the wear resistant copper or copper base alloy has a surface hardness of 300 or more.

8. The method of preparing the wear resistant copper or copper base alloy according to claim 1, wherein the oxide layer has a thickness of 15 to 300 nm.

9. The method of preparing the wear resistant copper or copper base alloy according to claim 1, wherein a copper base alloy is prepared, the alloy containing 0.01 to 40 weight % of at least one element selected from the group consisting of 0.01 to 40 weight % Zn, 0.1 to 10 weight % Sn, 0.01 to 5 weight % Fe, 0.01 to 10 weight % Ni, 0.01 to 5 weight % Co, 0.01 to 5 weight % Ti, 0.01 to 3 weight % Mg, 0.01 to 3 weight % Zr, 0.01 to 1 weight % Ca, 0.01 to 3 weight % Si, 0.01 to 10 weight % Mn, 0.01 to 5 weight % Cd, 0.01 to 10 weight % Al, 0.01 to 5 weight % Pb, 0.01 to 5 weight % Bi, 0.01 to 3 weight % Be, 0.01 to 1 weight % Te, 0.01 to 5 weight % Y, 0.01 to 5 weight % La, 0.01 to 5 weight % Cr, 0.01 to 5 weight % Ce, 0.01 to 5 weight % Au, 0.01 to 5 weight % Ag and 0.005 to 0.5 weight % P.

10. The method of preparing the wear resistant copper or copper base alloy according to claim 2, wherein the Cu—Sn is selected from the group consisting of $Cu_3Sn$, $Cu_4Sn$ and $Cu_6Sn_5$.

11. The method of preparing the wear resistant copper or copper base alloy according to claim 2, wherein the wear resistant copper or copper base alloy has a surface hardness of 300 or more.

12. The method of preparing the wear resistant copper or copper base alloy according to claim 2, wherein the oxide layer has a thickness of 15 to 300 nm.

13. The method of preparing the wear resistant copper or copper base alloy according to claim 2, wherein a copper base alloy is prepared, the alloy containing 0.01 to 40 weight % of at least one element selected from the group consisting of 0.01 to 40 weight % Zn, 0.1 to 10 weight % Sn, 0.01 to 5 weight % Fe, 0.01 to 10 weight % Ni, 0.01 to 5 weight % Co, 0.01 to 5 weight % Ti, 0.01 to 3 weight % Mg, 0.01 to 3 weight % Zr, 0.01 to 1 weight % Ca, 0.01 to 3 weight % Si, 0.01 to 10 weight % Mn, 0.01 to 5 weight % Cd, 0.01 to 10 weight % Al, 0.01 to 5 weight % Pb, 0.01 to 5 weight % Bi, 0.01 to 3 weight % Be, 0.01 to 1 weight % Te, 0.01 to 5 weight % Y, 0.01 to 5 weight % La, 0.01 to 5 weight % Cr, 0.01 to 5 weight % Ce, 0.01 to 5 weight % Au, 0.01 to 5 weight % Ag and 0.005 to 0.5 weight % P.

14. The method of preparing the wear resistant copper or copper base alloy according to claim 2, wherein the thickness of the Cu—Sn is 0.3 to 5 $\mu$m.

* * * * *